US011268246B2

(12) United States Patent
Ellis et al.

(10) Patent No.: US 11,268,246 B2
(45) **Date of Patent: *Mar. 8, 2022**

(54) SYSTEM AND METHOD FOR SECURING TUNED MASS DAMPERS TO RAIL

(71) Applicant: Polycorp Ltd., Elora (CA)

(72) Inventors: Richard Theodore Ellis, Kitchener (CA); Marco Leone, Cambridge (CA)

(73) Assignee: Polycorp Ltd., Ontario (CA)

( * ) Notice: Subject to any disclaimer, the term of this patent is extended or adjusted under 35 U.S.C. 154(b) by 442 days.

This patent is subject to a terminal disclaimer.

(21) Appl. No.: 16/363,185

(22) Filed: Mar. 25, 2019

(65) Prior Publication Data

US 2020/0087862 A1 Mar. 19, 2020

Related U.S. Application Data

(63) Continuation-in-part of application No. 16/133,244, filed on Sep. 17, 2018.

(51) Int. Cl.

| | |
|---|---|
| ***E01B 19/00*** | (2006.01) |
| ***E01B 29/32*** | (2006.01) |
| ***E01B 29/24*** | (2006.01) |

(52) U.S. Cl.

CPC ..... *E01B 19/003* (2013.01); *E01B 29/24* (2013.01); *E01B 29/32* (2013.01); *E01B 2201/08* (2013.01)

(58) Field of Classification Search

CPC ..... E01B 19/003; E01B 29/24; E01B 29/32; E01B 2201/08

See application file for complete search history.

(56) References Cited

U.S. PATENT DOCUMENTS

| | | | | |
|---|---|---|---|---|
| 6,213,407 | B1 | 4/2001 | Ellis et al. | |
| 6,390,382 | B1 * | 5/2002 | Hodgson | E01B 19/003 105/452 |
| 7,234,647 | B2 * | 6/2007 | Wirthwein | E01B 19/003 238/382 |

(Continued)

FOREIGN PATENT DOCUMENTS

| | | | |
|---|---|---|---|
| EP | 1015698 | B1 | 4/2004 |

OTHER PUBLICATIONS

The Noise-Absorber System, Strailastic_A, Kraiburg Elastik GmbH, Feb. 2015.

(Continued)

*Primary Examiner* — Zachary L Kuhfuss

(57) ABSTRACT

A tuned mass damper for damping airborne vibrations at one or more rail frequencies from a rail generated by movement of wheels over the rail. The tuned mass damper includes one or more damper elements including a damper element material, and a body element including a body material. The damper elements are at least partially embedded in the body element. The body element has inner and lower exterior surfaces formed to fit within first and second pockets on opposite first and second sides of the rail defined by a web portion and a foot. The damper element material and the body material are selected and formed so that the tuned mass damper vibrates in response to movement of the wheels over the rail at one or more damper frequencies that at least partially interferes with the rail frequencies.

11 Claims, 19 Drawing Sheets

(56) References Cited

U.S. PATENT DOCUMENTS

| | | | | |
|---|---|---|---|---|
| 7,427,035 | B2 * | 9/2008 | Farrington | E01B 19/003 238/382 |
| 7,641,129 | B2 * | 1/2010 | Farrington | E01B 19/003 238/382 |
| 8,353,464 | B2 * | 1/2013 | Ho | E01B 19/003 238/382 |
| 9,970,161 | B2 * | 5/2018 | Li | E01B 19/003 |
| 10,487,456 | B2 * | 11/2019 | Ansari | F16F 7/108 |
| 2006/0144659 | A1 | 7/2006 | Wang et al. | |
| 2015/0345083 | A1 | 12/2015 | Veit | |
| 2020/0087864 | A1 * | 3/2020 | Ellis | E01B 29/32 |

OTHER PUBLICATIONS

Silent Track, Reducing Railway Noise, Tata Steel Europe Ltd., Apr. 2014.

Shock and Vibration Technology, Schrey & Veit, www.railway-technology.com/contractors/noise/schrey, Verdict Media Limited, downloaded Aug. 28, 2018.

Granuflex-Rail, Flexible Solutions, Rubber Products 2015, www.granuflex.hu, Dec. 2015.

* cited by examiner

SYSTEM AND METHOD FOR SECURING TUNED MASS DAMPERS TO RAIL

This application is a continuation-in-part of U.S. patent application Ser. No. 16/133,244, filed on Sep. 17, 2018, which is hereby incorporated herein by reference in its entirety.

FIELD OF THE INVENTION

The present invention is a system and a method for securing tuned mass dampers to rail.

BACKGROUND OF THE INVENTION

Various devices for securing rail seals to a rail are known. The rail seals typically are used at level crossings, where the rail seals and the clips used to hold the rail seals in place are typically buried under asphalt or concrete at the level crossing, after installation. A clip assembly for a rail seal is illustrated and described in U.S. Pat. No. 6,213,407. Because the clip assembly and the rail seal held thereby are intended to be covered by asphalt or concrete, the extent to which the clip assembly extends outwardly from the rail is generally not important.

In contrast, tuned mass dampers may be attached or secured to linear rails, along the lengths of rail outside the level crossings. The tuned mass dampers primarily are designed to minimize the extent to which vibrations resulting from traffic over the rails may be transmitted as airborne noise. As is known in the art, the tuned mass dampers are formed to have a mass and an overall density designed to dampen vibrations of the rail generated by the movement of rail car wheels along the rail.

It is important that the installed tuned mass dampers, and the devices holding them to the rail, extend outwardly from the rail only a relatively short distance. This is in contrast to the less onerous requirements for conventional clip assemblies securing rail seals at level crossings, described above. Along the exposed parts of the rail that are located outside the level crossings, the devices that secure the tuned mass dampers to rails are required to fit within a relatively small envelope or perimeter relative to the rail. This is due to the routine rail and track bed maintenance tasks (e.g., ballast tamping, and rail grinding) that are required to be done to the rail and ballast located outside the level crossings. In order for these routine maintenance tasks to be completed efficiently, the tuned mass dampers and the clips holding them may extend outwardly from the track only a relatively short distance.

The prior art devices that have been used to secure tuned mass dampers to a rail outside the level crossings are generally unsatisfactory because they are relatively expensive, and/or difficult to use, and/or ineffective.

SUMMARY OF THE INVENTION

There is a need for a system and a method for securing tuned mass dampers to a rail that overcome or mitigate one or more of the disadvantages or defects of the prior art. Such disadvantages or defects are not necessarily included in those described above.

In its broad aspect, the invention provides a tuned mass damper for damping airborne vibrations at one or more rail frequencies from a rail generated by movement of wheels over the rail. The rail has a web portion supported by a foot thereof. The web portion and the foot define first and second pockets on opposite first and second sides of the rail. The tuned mass damper includes one or more damper elements including a damper element material, and a body element including a body material. The damper elements are at least partially embedded in the body element. The body element has inner and lower exterior surfaces formed to fit within the first and second pockets. The damper element material and the body material are selected and formed so that the tuned mass damper vibrates in response to movement of the wheels over the rail at one or more damper frequencies that at least partially interfere with the one or more rail frequencies.

In another of its aspects, the invention includes a system for damping airborne vibrations at one or more rail frequencies from a rail generated by movement of wheels over the rail. The system includes first and second tuned mass dampers formed to be positioned in the first and second pockets respectively. Each tuned mass damper includes one or more damper elements including a damper element material, and a body element including a body material. The damper element is at least partially embedded in the body element. The body element has inner and lower exterior surfaces formed to fit within the first and second pockets. The damper element material and the body material are selected and formed so that the tuned mass damper vibrates in response to movement of the wheels over the rail at one or more damper frequencies that at least partially interfere with the one or more rail frequencies. The system also includes one or more clip assemblies for securing the first and second tuned mass dampers in the first and second pockets respectively. The clip assembly includes a bar element and a second clamping arm for engaging the first and second tuned mass dampers, to secure the first and second tuned mass dampers in the first and second pockets respectively.

BRIEF DESCRIPTION OF THE DRAWINGS

The invention will be better understood with reference to the attached drawings, in which.

DETAILED DESCRIPTION

Figure 1A:
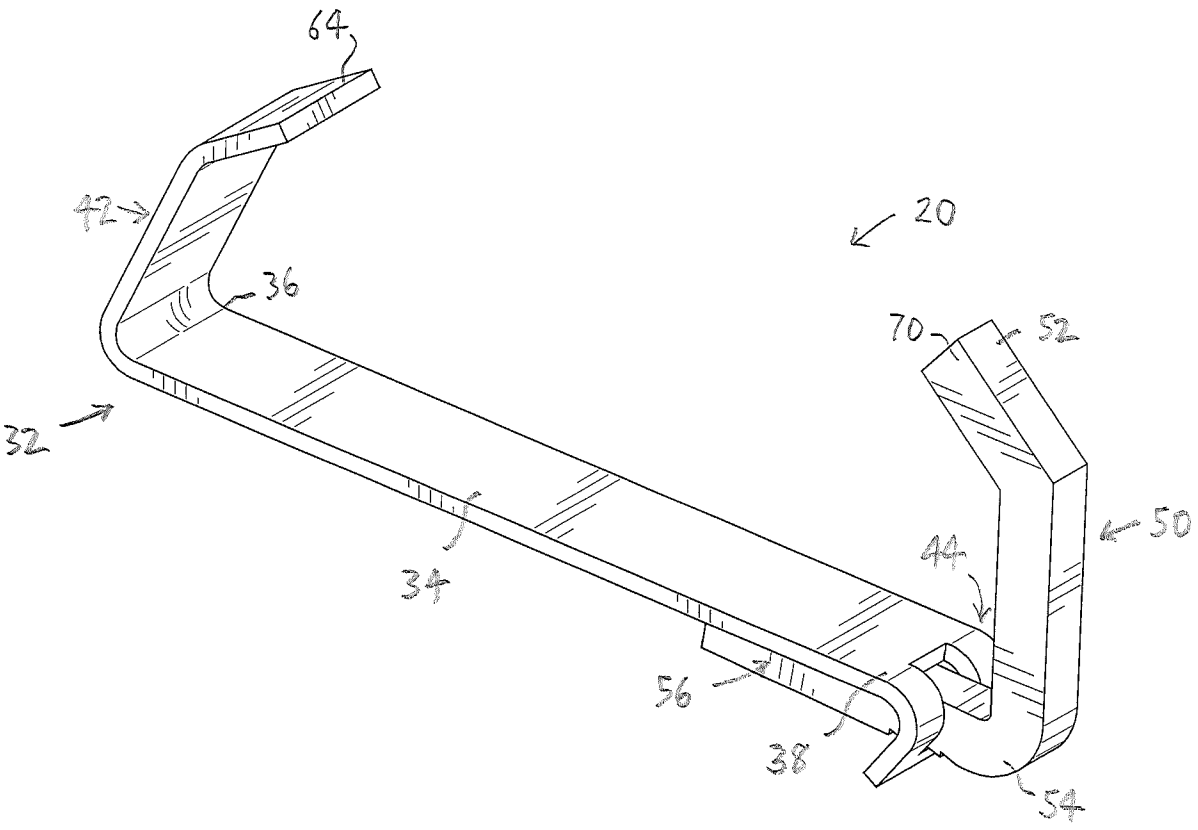
FIG. 1A is an isometric view of an embodiment of a clip assembly of the invention.
Figure 1B:
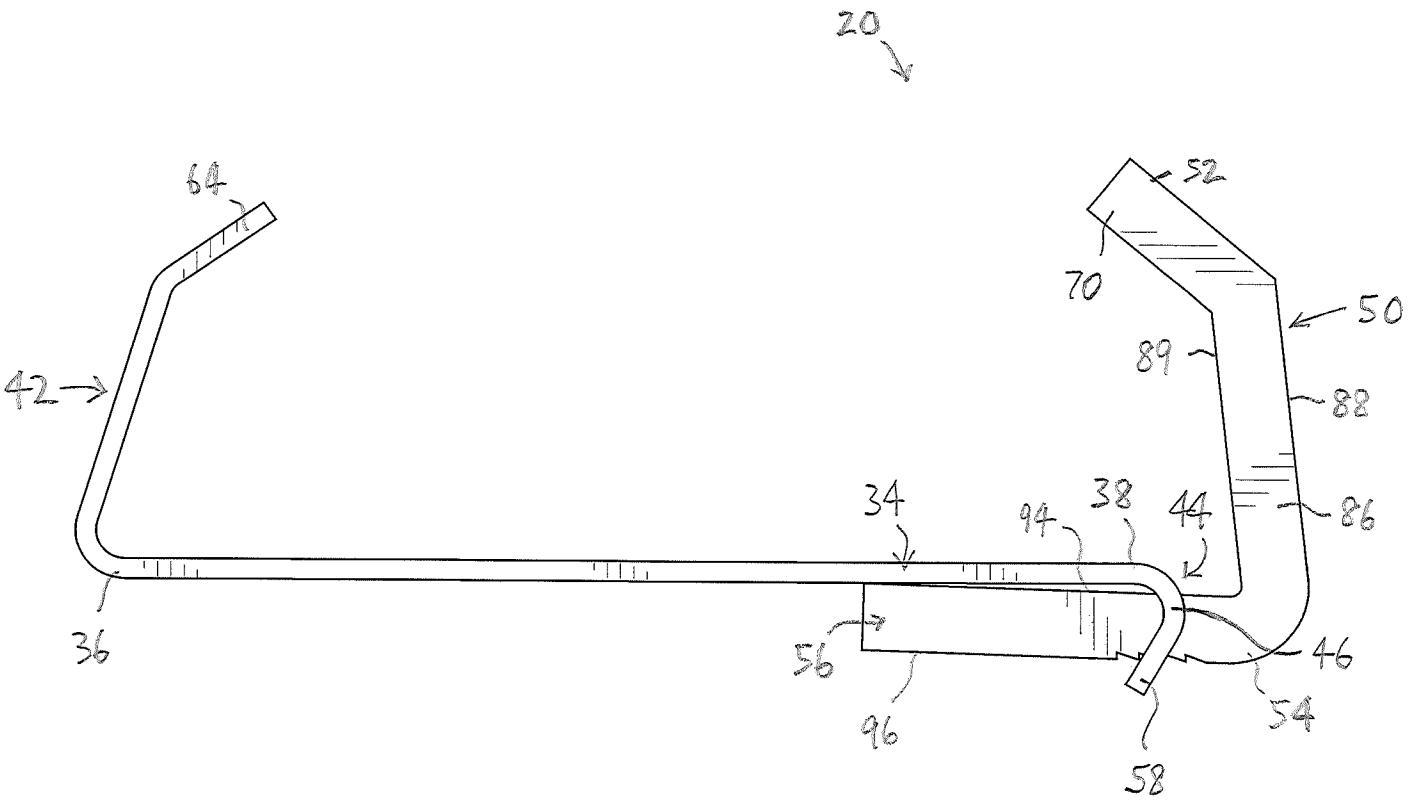
FIG. 1B is a side view of the clip assembly of FIG. 1A.
Figure 1C:
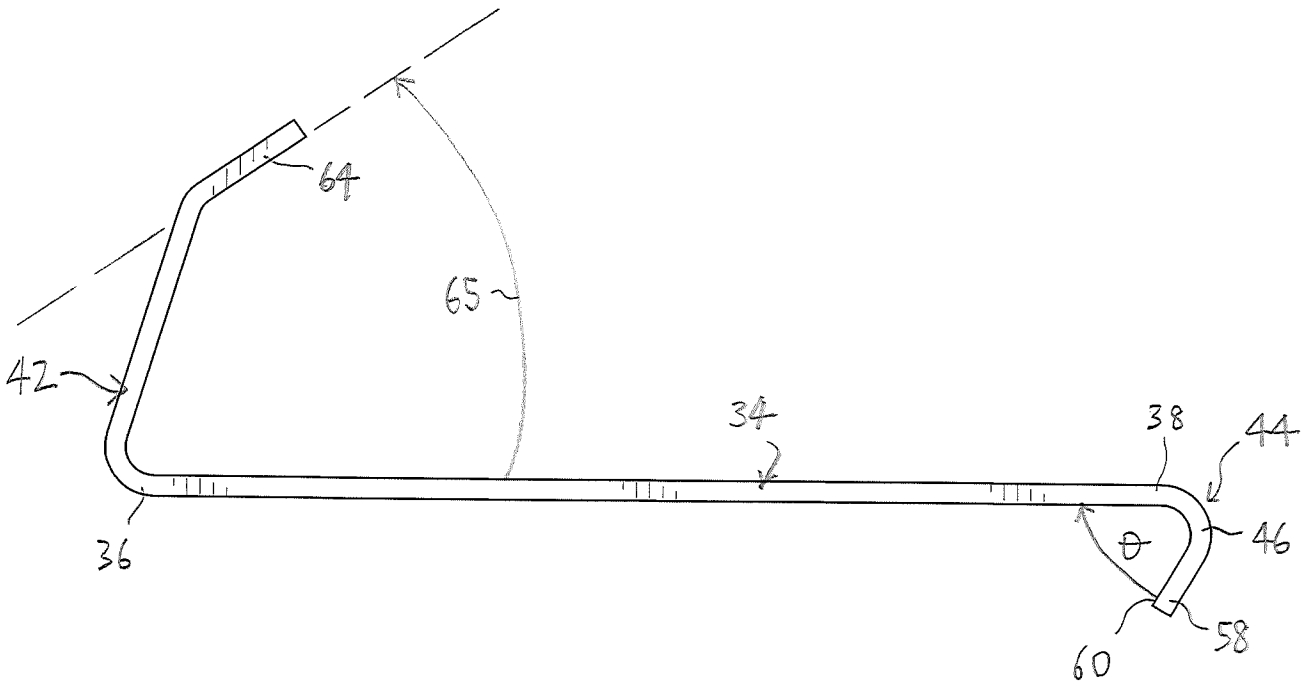
FIG. 1C is a side view of a bar element of the clip assembly of FIG. 1A.

In the attached drawings, like reference numerals designate corresponding elements throughout. Reference is first made to FIGS. 1A-2B to describe an embodiment of a clip assembly of the invention indicated generally by the numeral 20. As will be described, the clip assembly 20 is for securing first and second tuned mass dampers 22, 24 to respective first and second sides 26, 28 of a rail 30 (FIG. 2A). In one embodiment, the clip assembly 20 preferably includes a bar element 32, which has a connector portion 34 extending between first and second ends 36, 38 thereof (FIGS. 1A, 1B) and which is formed to be positioned in a predetermined location relative to the rail 30 at least partially under a foot 40 of the rail 30 (FIG. 2A). It is also preferred that the bar element 32 includes a first clamping arm 42 connected with the connector portion 34 at the first end 36 of the connector portion 34 (FIGS. 1A, 1B). As will also be described, the first clamping arm 42 preferably is formed to engage the first tuned mass damper 22, to urge the first tuned mass damper 22 against the first side 26 of the rail 30 and at least partially downwardly toward the foot 40, when the connector portion 34 is in the predetermined location (FIG. 2A).

Figure 2A:
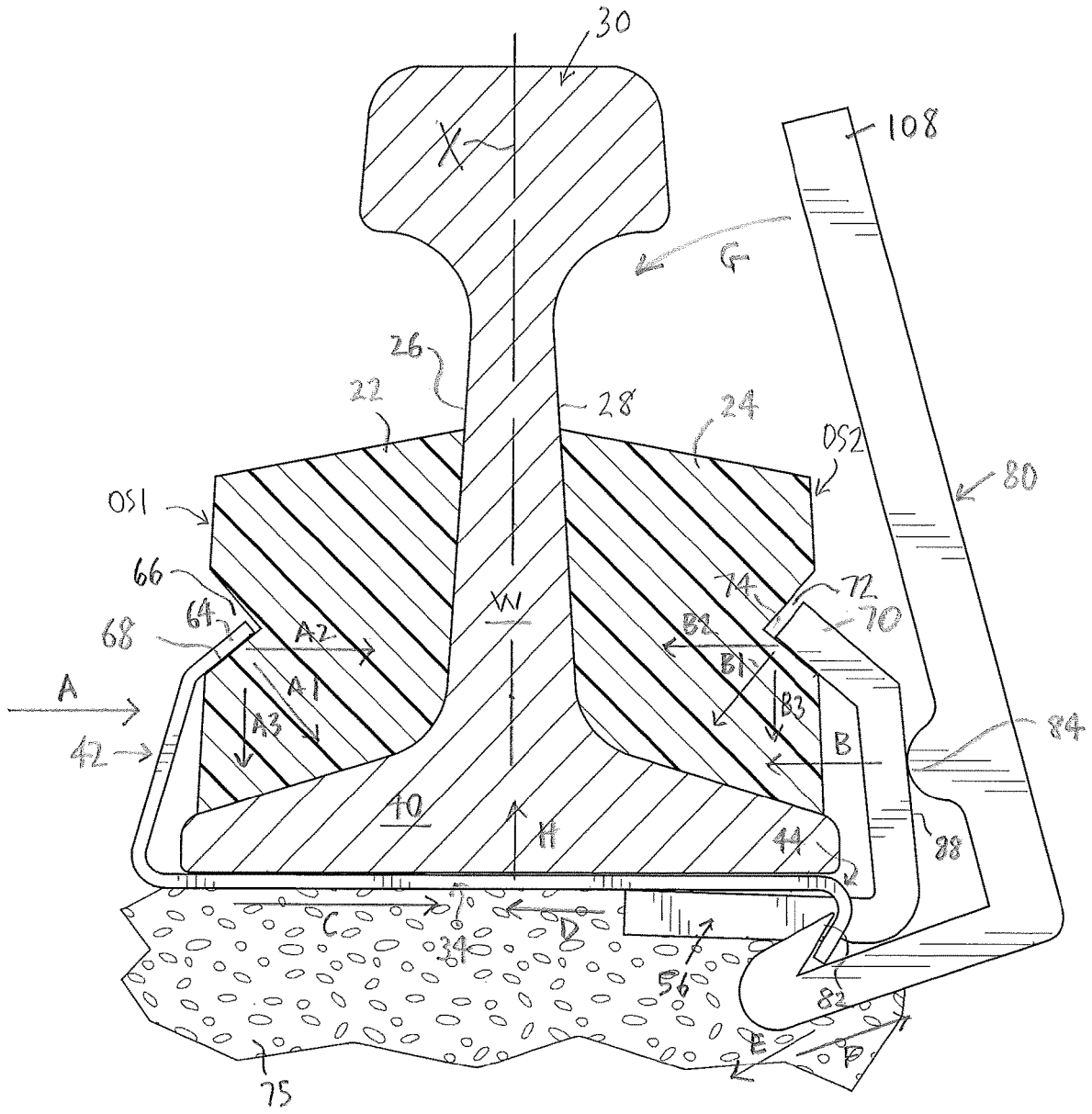
FIG. 2A is a cross-section of a rail and first and second tuned mass dampers secured to the rail and a side view of the clip assembly of FIG. 1A, securing the tuned mass dampers to the rail, with an embodiment of an installation tool of the invention engaged with the clip assembly.
Figure 2B:
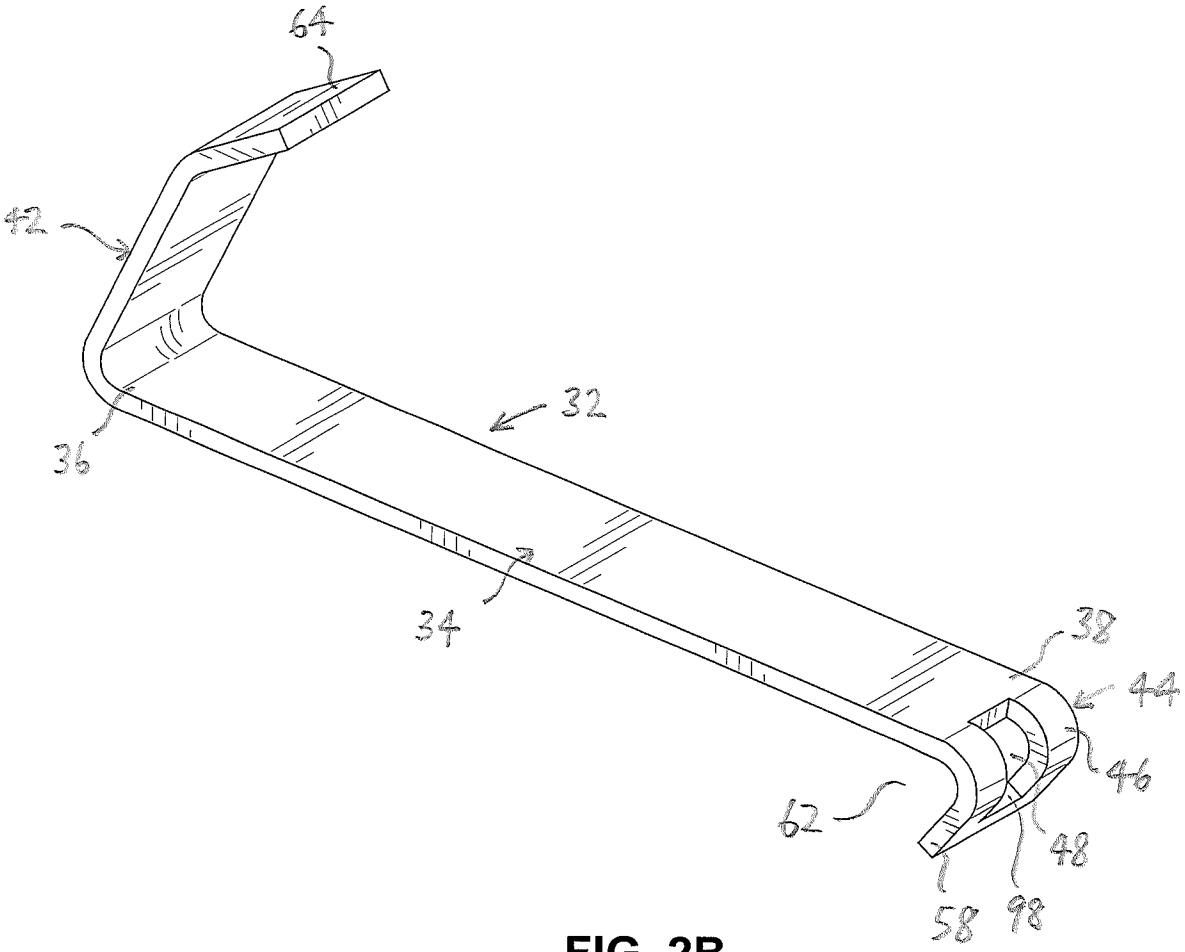
FIG. 2B is an isometric view of an embodiment of a bar element of the invention.

The bar element 32 preferably also includes a linkage section 44 connected with the connector portion 34 at the second end 38 of the connector portion 34. As can be seen in FIG. 2B, the linkage section 44 preferably includes a curved wall 46 with an opening 48 therein.

Figure 1D:
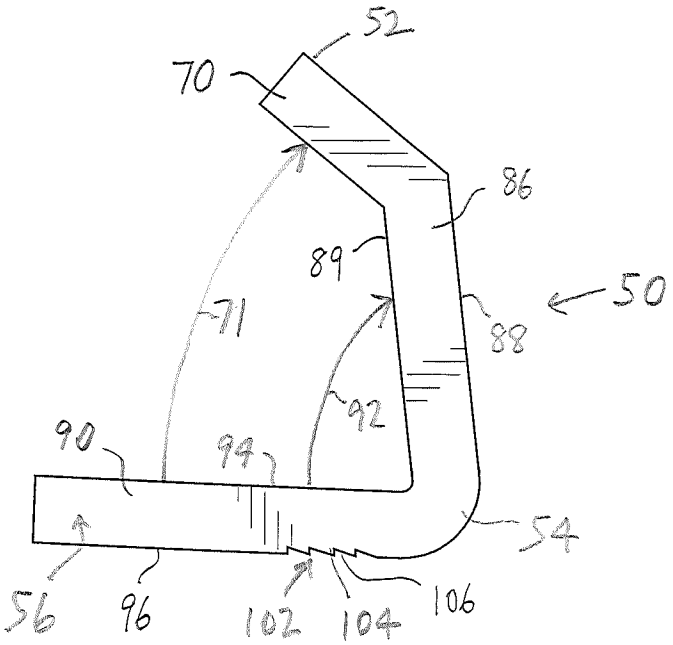
FIG. 1D is a side view of a second clamping arm of the clip assembly of FIG. 1A.
Figure 2C:
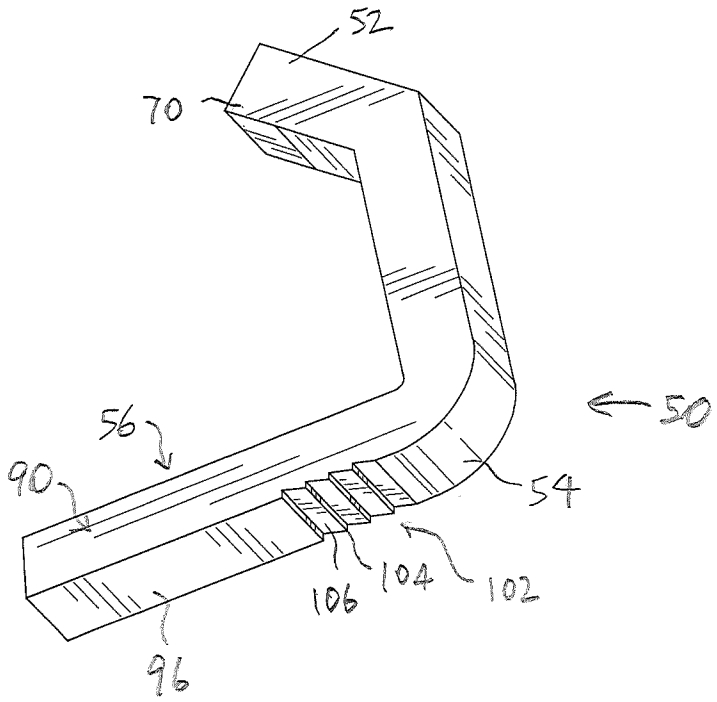
FIG. 2C is an isometric view of an embodiment of a second clamping arm of the invention.

In one embodiment, the clip assembly 20 preferably also includes a second clamping arm 50 extending between upper and lower ends 52, 54 thereof (FIGS. 1D, 2C). Preferably, the lower end 54 includes a locking portion 56 (FIG. 1D) that is at least partially receivable in the opening 48 in the curved wall 46. The locking portion 56 preferably is securable to the linkage section 44, as will also be described. It is also preferred that the upper end 52 is formed for engagement with the second tuned mass damper 24, to urge the second tuned mass damper 24 against the second side 28 of the rail 30 and at least partially downwardly toward the foot 40.

As will be described, the first and second sides 26, 28 are sides of a web portion "W" of the rail 30.

As can be seen in FIGS. 1B, 10, and 2B, in one embodiment, the curved wall 46 preferably also includes one or more bracing elements 58. The bracing element 58 preferably includes an interior surface 60 defining a gap 62 between the interior surface 60 and the connector portion 34 (FIG. 2B). It is also preferred that the interior surface 60 is planar, or at least partially planar, and defines an acute angle Θ between the interior surface 60 and the connector portion 34 (FIG. 10).

As can be seen in FIGS. 1B, 10, and 2A, in one embodiment, the first clamping arm 42 preferably includes a first engagement portion 64, for engaging the first tuned mass damper 22. Preferably, the first engagement portion 64 defines a first acute angle 65 between the first engagement portion 64 and the connector portion 34 (FIG. 10).

It can also be seen in FIG. 2A that the first tuned mass damper 22 includes a recessed region 66 that is partially defined by a lower surface 68, and the first engagement portion 64 preferably is configured to mate with the lower surface 68. The lower surface 68 preferably is substantially planar, and also defines an acute angle 65' (FIG. 4C) relative to the horizontal that is substantially the same as the acute angle 65 between the lower surface 68 and the connector portion 34.

The first engagement portion 64 preferably is located relative to the connector portion 34 so that, when the first clamping arm 42 is urged in a first direction (generally indicated by arrow "A" in FIG. 2A) against the first tuned mass damper 22, the first engagement portion 64 engages the lower surface 68. As noted above, in one embodiment, the lower surface 68 may be substantially parallel to the first engagement portion 64.

When the first engagement portion 64 engages the lower surface 68 and is urged against the lower surface 68, the force exerted by the first engagement portion 64 (schematically represented by arrow "A1" in FIG. 2A) against the first tuned mass damper 22 may be characterized or represented as comprising two components, namely, a horizontal component (schematically represented by arrow "A2" in FIG. 2A) toward the rail, and a vertical component (schematically represented by arrow "A3" in FIG. 2A).

As illustrated in FIG. 2A, the force exerted by the first engagement portion 64 upon the lower surface 68 is directed at an angle of approximately 40° from the vertical. Also, as illustrated, the direction of the resulting pressure on the lower surface 68 is substantially orthogonal to the lower surface 68. However, it will be understood that the direction of the force schematically represented by arrow "A1" in FIG. 2A is exemplary only. Those skilled in the art would appreciate that the direction of the pressure resulting from the engagement of the first engagement portion with the lower surface 68 may be over a variety of directions, depending on various parameters.

As can be seen in FIG. 2A, when the first engagement portion 64 is urged against the lower surface 68, the first engagement portion 64 partially exerts a horizontally directed force (schematically represented by arrow "A2" in FIG. 2A) toward the rail 30, and partially exerts a downwardly directed force (schematically represented by arrow "A3" in FIG. 2A) that is directed generally toward the foot 40 of the rail 30.

The Applicant has determined that the tuned mass dampers 22, 24 are more effective at damping airborne vibration (i.e., noise) when they are at least partially urged downwardly, against the foot 40 of the rail 30. That is, a tuned mass damper that is solely urged in a substantially horizontal direction by engagement of the first engagement portion 64 with the lower surface 68 has been found to dampen noise less effectively than if the tuned mass damper were urged both horizontally and downwardly (i.e., as illustrated for exemplary purposes in FIG. 2A), upon engagement of the lower surface 68 by the first engagement portion 64.

It is also preferred that the second clamping arm 50 includes a second engagement portion 70 at the upper end 52 thereof, for engaging the second tuned mass damper 24. As can be seen in FIG. 1D, the second engagement portion 70 preferably defines a second acute angle 71 between the second engagement portion 70 and the locking portion 56.

It can also be seen in FIG. 2A that the second tuned mass damper 24 includes a recessed region 72 that is partially defined by a lower surface 74, and the second engagement portion 70 preferably is configured to mate with the lower surface 74. The lower surface 74 preferably is substantially planar, and also defines an acute angle relative to the horizontal that is substantially the same as the acute angle 71 between the lower surface 74 and the connector portion 34.

The second engagement portion 70 preferably is located relative to the locking portion 56 so that, when the second clamping arm 50 is urged in a second direction (generally indicated by arrow "B" in FIG. 2A) against the second tuned mass damper 24, the second engagement portion 70 engages the lower surface 74. As noted above, in one embodiment, the lower surface 74 may be substantially parallel to the second engagement portion 70.

When the second engagement portion 70 engages the lower surface 74 and is urged against the lower surface 74, the force exerted by the second engagement portion 70 (schematically represented by arrow "B1" in FIG. 2A) against the second tuned mass damper 24 may be characterized or represented as comprising two components, namely, a horizontal component (schematically represented by arrow "B2" in FIG. 2A) toward the rail, and a vertical component (schematically represented by arrow "B3" in FIG. 2A).

As illustrated in FIG. 2A, the force exerted by the second engagement portion 70 upon the lower surface 74 is directed at an angle of approximately 40° from the vertical. Also, as illustrated, the direction of the resulting pressure on the lower surface 74 is substantially orthogonal to the lower surface 74. However, it will be understood that the direction of the force schematically represented by arrow "B1" in FIG. 2A is exemplary only. Those skilled in the art would appreciate that the direction of the pressure resulting from the engagement of the second engagement portion with the lower surface 74 may be directed over a variety of directions, depending on various parameters.

Those skilled in the art would appreciate that the forces schematically represented by the arrows "A1" and "B1" in FIG. 2A preferably are substantially symmetrical relative to a vertical axis (identified by "X" in FIG. 2A) of the rail 30.

As can be seen in FIG. 2A, when the second engagement portion 70 is urged against the lower surface 74, the second engagement portion 70 partially exerts a horizontally directed force (schematically represented by arrow "B2" in FIG. 2A) toward the rail 30, and partially exerts a downwardly directed force (schematically represented by arrow "B3" in FIG. 2A) that is directed generally toward the foot 40 of the rail 30.

As noted above, the Applicant has determined that the tuned mass dampers 22, 24 are more effective at damping airborne vibration (i.e., noise) when they are at least partially urged downwardly, against the foot 40 of the rail 30.

As can be seen in FIG. 2A, it is preferred that the first and second tuned mass dampers 22, 24 are positioned on opposite sides of the rail 30. It will be understood that the second tuned mass damper 24 is the mirror image of the first tuned mass damper 22. Accordingly, to avoid repetition, only the first tuned mass damper 22 is described herein in detail.

Figure 4A:
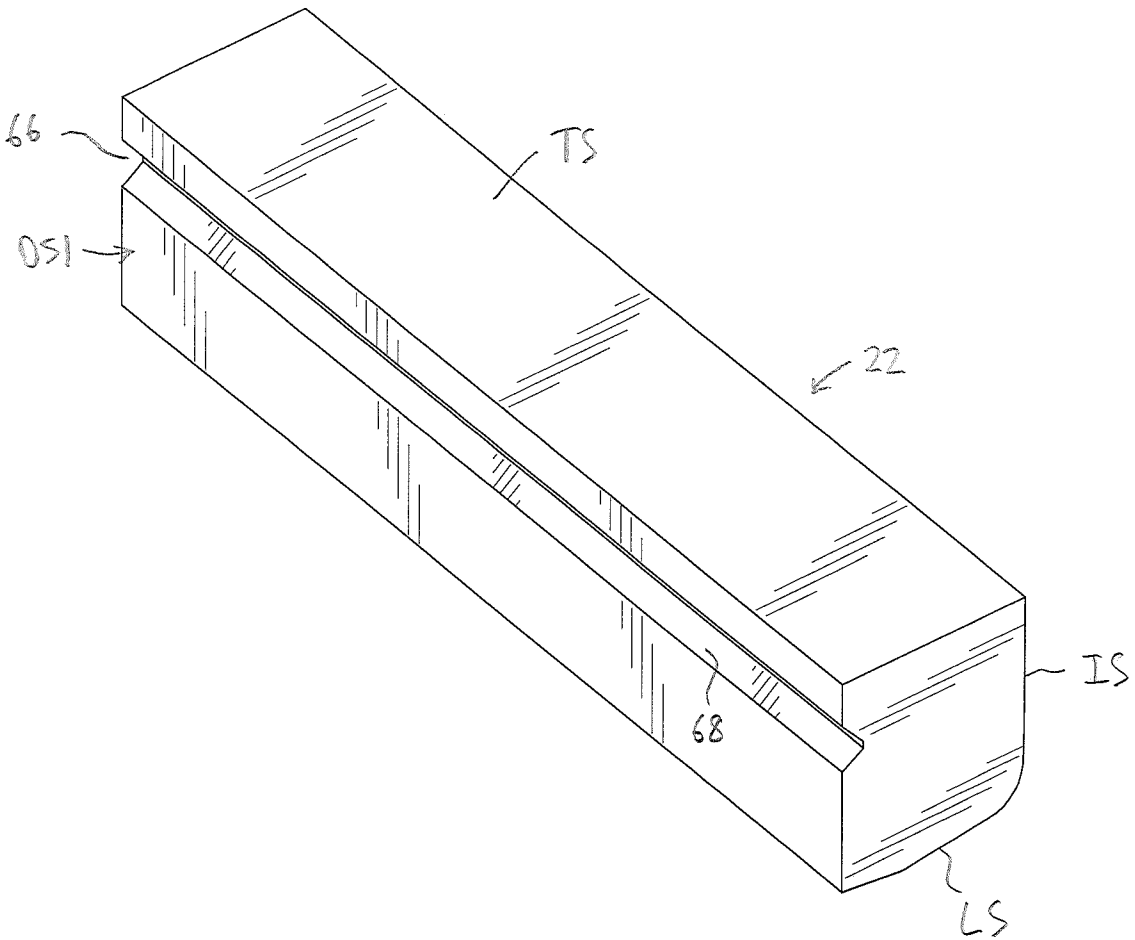
FIG. 4A is an isometric view of an embodiment of a tuned mass damper of the invention, drawn at a smaller scale.
Figure 4B:
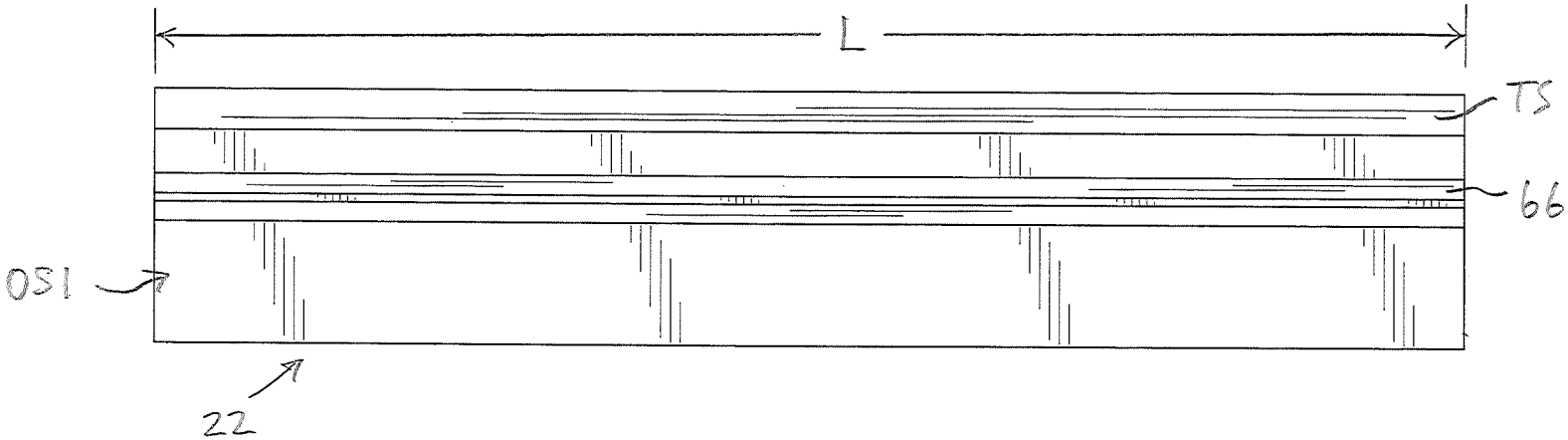
FIG. 4B is a side view of the tuned mass damper of FIG. 4A.
Figure 4C:
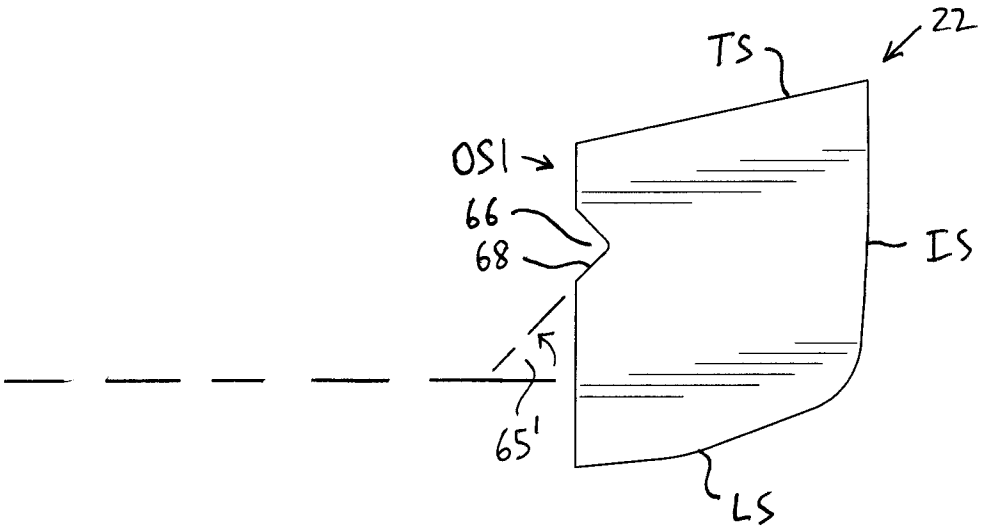
FIG. 4C is an end view of the tuned mass damper of FIGS. 4A and 4B.

The first tuned mass damper 22 is also illustrated in FIGS. 4A-4C. As can be seen in FIGS. 4A and 4B, the first tuned mass damper 22 has a length "L". The tuned mass damper may have any suitable length. In one embodiment, it is preferred that the tuned mass damper is formed to fit between railway ties. The length of the tuned mass damper therefore may depend, for instance, on the spacing between the railway ties. For instance, the tuned mass damper may have a length of approximately 12 to 18 inches.

As can be seen in FIG. 2A, the first and second tuned mass dampers 22, 24 preferably are at least partially defined by substantially vertical outer surfaces "OS1", "OS2" that are interrupted by the recessed regions 66 and 72 respectively.

Those skilled in the art would appreciate that the tuned mass dampers may be made of any suitable material, or combination of materials, to provide a tuned mass damper with suitable density and stiffness. The tuned mass dampers ideally have densities and other physical characteristics so that the tuned mass dampers, once secured to the rail, minimize airborne noise generated by movement of wheels over the rail. For instance, in one embodiment, the tuned mass dampers may include pieces of steel or any other suitable inelastic material embedded in an elastomeric matrix.

As can be seen in FIGS. 4A-4C, the tuned mass damper preferably is formed with an inner side "IS" configured to mate with the web portion "W" of the rail 30, and a lower side "LS" configured to mate with the foot 40. The inner side "IS" of the first tuned mass damper 22 is formed to mate with the first side 26 of the web portion "W", and the inner side "IS" of the second tuned mass damper 24 is formed to mate with the second side 28 of the web portion "W". Preferably, the tuned mass damper also includes a top surface "TS" formed for drainage of water outwardly therefrom, away from the rail 30.

As noted above, it is important that the extent to which the clip assembly 20, once installed, extends laterally outwardly from the outer sides "OS1" and "OS2" be minimized. Preferably, the sizes of the tuned mass dampers are minimized. Because of the recessed regions 66, 72, once the clip assembly 20 is installed, the extent to which the first and second clamping arms 44, 50 extend laterally outwardly from the outer sides "OS1" and "OS2" is minimized.

As will be described, it is preferred that the clip assembly 20 initially is manually positioned on the first and second tuned mass dampers 22, 24, and also on the rail 30. It will be understood that, when the clip assembly 20 has been manually positioned on the first and second tuned mass dampers 22, 24, the first and second engagement portions 64, 70 may only lightly engage the respective lower surfaces 68, 74. Once the clip assembly 20 is positioned so that the first and second engagement portions 64, 70 engage the lower surfaces 68, 74, the second clamping arm 50 is urged in the direction indicated by arrow "B", and the first clamping arm 42 is urged in the direction indicated by arrow "A", to install the clip assembly 20 against the first and second tuned mass dampers 22, 24.

As a practical matter, it is convenient for a user (not shown) to manually position the bar element 32 so that the linkage section 44 is positioned underneath the foot 40, proximal to the second tuned mass damper 24, and the first engagement portion 64 is at least proximal to the lower surface 68 of the first tuned mass damper 22 (FIG. 2A). Once the bar element 32 is so positioned, the second clamping arm 50 preferably is engaged therewith, by the user inserting the locking portion 56 of the second clamping arm 50 into the opening 48 in the curved wall 46 of the linkage section 44. Preferably, the user then pushes the second clamping arm 50 toward the second tuned mass damper 24, to lightly engage the second engagement portion 70 with the lower surface 74 of the second tuned mass damper 24.

Those skilled in the art would appreciate that the rail 30 may be supported by sleepers or railway ties (not shown) that are spaced apart from each other along the rail 30. Ballast 75 is located between the railway ties (FIG. 2A), and also under the railway ties. FIG. 2A includes a cross-section of the rail 30 and of the first and second tuned mass dampers 22, 24 taken between two of the railway ties. It will be understood that, in use, a number of the clip assemblies 20 preferably are positioned along the rail 30, spaced apart from each other at selected locations between the railway ties.

Those skilled in the art would appreciate that, in order to install the clip assembly 20, the linkage section 44 of the bar element 32 is first inserted into the ballast 75, underneath a left (or first) side 76 of the foot 40 (FIG. 2A). The bar element 32 preferably is then pushed in a third direction (indicated by arrow "C" in FIG. 2A) that is generally the same as the first direction, but may be non-horizontal. As illustrated in FIG. 2A, the third direction is generally from left to right.

Those skilled in the art would also appreciate that the amount of the ballast 75 at respective locations along the track relative to the rail may vary. Once the location for the tuned mass dampers has been selected, they are installed with the clip assemblies positioned as needed.

The bar element 32 preferably is manually pushed in the direction indicated by arrow "C" until the first engagement portion 64 engages the lower surface 68 of the first tuned mass damper 22. As noted above, the first engagement portion 64 may only lightly engage the lower surface 68, because the installation at this point is done manually. When the bar element 32 is at the point where the first engagement portion 64 lightly engages the lower surface 68, the connector portion 34 of the bar element 32 is in its predetermined location. It is preferred that, when the connector portion 34 is in the predetermined location therefor, the connector portion 34 is horizontal, or substantially horizontal, as illustrated in FIG. 2A. However, those skilled in the art would appreciate that the connector portion 34 may alternatively be located underneath the foot 40 in a position that is non-horizontal.

As can be seen in FIG. 2A, when the connector portion 34 is in its predetermined location, the linkage section 44 preferably is located proximal to a right (or second) side 78 of the foot 40. The second side 78 of the foot 40 is located generally below the second tuned mass damper 24. Once the connector portion 34 is in the predetermined location therefor, it is preferred that the locking portion 56 of the second clamping arm 50 is inserted into the opening 48 in the curved wall 46, and the second clamping arm 50 is moved manually in a fourth direction indicated by arrow "D" in FIG. 2A until the second engagement portion 70 engages the lower surface 74 of the second tuned mass damper 24. As noted above, at this point, although the first and second engagement portions 64, 70 preferably are engaging the respective lower surfaces 68, 74, the first and second engagement portions 64, 70 preferably are subjected to only minimal pressure, i.e., only such pressure as may be needed in order to locate them on the respective lower surfaces 68, 74.

Figure 3:
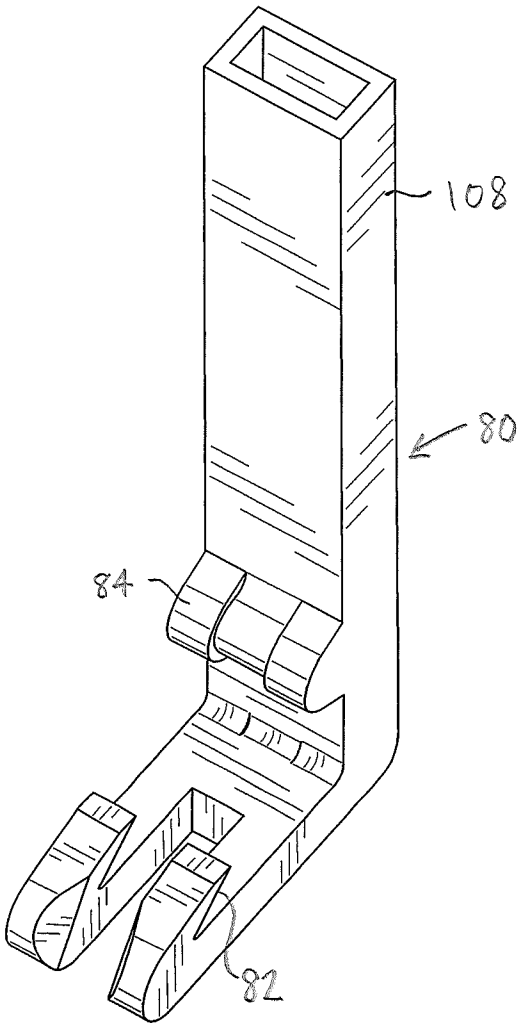
FIG. 3 is an isometric view of the installation tool of FIG. 2A.

Once the second clamping arm 50 is positioned with the locking portion 56 in the opening 48 and the second engagement portion 70 engaging the lower surface 74, the clip assembly 20 preferably is secured to the first and second tuned mass dampers 22, 24 by an installation tool 80. As can be seen in FIG. 3, the installation tool 80 preferably includes first and second contact portions 82, 84. To secure the clip assembly 20 to the first and second tuned mass dampers 22, 24, the first contact portion 82 preferably is engaged with the interior surface 60 of the bracing element 58, and the second contact portion 84 preferably is engaged with the second clamping arm 50, as will also be described.

As can be seen in FIGS. 1A-2A and 2C, it is preferred that the second clamping arm 50 additionally includes a bearing surface portion 86 located between the upper and lower ends 52, 54 thereof. Preferably, the bearing surface portion 86 has a planar bearing surface 88, and an internal side 89 located opposite to the bearing surface 86 (FIG. 1D). The installation tool 80 is used to secure the clip assembly 20 to the first and second tuned mass dampers 22, 24 by, with the tool 80, pulling in the first direction on the linkage section 44 while simultaneously pushing in the second direction on the bearing surface 88, as will be described. The first direction is generally indicated by arrow "A" in FIG. 2A, and the second direction is indicated by arrow "B" in FIG. 2A. As can be seen, e.g., in FIG. 2A, the result of this is that the bar element 32 and the second clamping arm 50 are urged toward each other, to simultaneously squeeze the first and second mass dampers 22, 24 between the first and second engagement portions 64, 70 respectively.

As can be seen in FIGS. 1D, 2A, and 2C, the second clamping arm 50 preferably is configured for cooperating with the linkage section 44 of the bar element 32, and also for cooperating with the installation tool 80, to secure the first engagement portion 64 and the second engagement portion 70 to the first and second tuned mass dampers 22, 24 respectively. In one embodiment, the locking portion 56 of the second clamping arm 50 preferably includes a linear locking portion body 90 that is positioned transverse to the bearing surface portion 86, to define an acute angle 92 between the locking portion body 80 and the internal side 89 of the bearing surface portion 86 (FIG. 1D).

As illustrated in FIGS. 1B and 1D, it is preferred that the locking portion body 90 has an upper surface 94 that is positioned to face upwardly when the locking portion 56 is received in the opening 48 in the curved wall 46, and a lower surface 96 positioned to face downwardly when the locking portion 56 is received in the opening 48 in the curved wall 46.

In one embodiment, the curved wall 46 of the linkage section 44 preferably includes a lower edge element 98 that a least partially defines the opening 46 (FIG. 2B). As can be seen in FIG. 1D, the lower surface 96 of the locking portion body 90 preferably includes a number of locking elements 102 that are formed for engagement with the lower edge element 98, to hold the locking portion 56 in the linkage section 44 in order to hold the second engagement portion 70 of the second clamping arm 50 against the second tuned mass damper 24.

Preferably, the locking elements 102 include a number of teeth 104 (FIG. 1D) that are configured to permit slidable engagement of the lower edge element 98 with the teeth 104, when the locking portion 56 is moved in the opening 48 in the second direction (i.e., indicated by arrow "B" in FIG. 2A) toward the first end 36 of the connector portion 34. The teeth 104 are also formed to engage the lower edge element 98 to prevent movement of the locking portion 56 in the first direction, i.e., to prevent movement of the locking portion 56 out of the opening 48, generally in the first direction.

It will be understood that the teeth 104 preferably define notches 106 therebetween respectively (FIG. 1D), and at least a portion of the lower edge element 98 of the curved wall 46 preferably is securely receivable in any one of the notches 106.

In one embodiment, the locking elements may include only one tooth. In this configuration, the notch is positioned adjacent to the tooth.

Preferably, after the clip assembly 20 has been manually installed as described above (i.e., with the first and second engagement portions 64, 70 lightly engaging the respective lower surfaces 68, 74, and the locking portion 56 received in the opening 48 of the curved wall 46), the first contact portion 82 of the installation tool 80 is pushed into the ballast 75, in the direction generally indicated by arrow "E" in FIG. 2A. Subsequently, the first contact portion 82 preferably is partially withdrawn from the ballast 75 in the direction generally indicated by arrow "F" in FIG. 2A, so that the first contact portion 82 can hook onto the bracing element 58. It is preferred that the first contact portion 82 engages the interior surface 60 of the bracing element 58, as illustrated in FIG. 2A.

Once the first contact portion 82 engages the bracing element 58, an upper end 108 of the installation tool 80 preferably is moved in the direction indicated by arrow "G" in FIG. 2A, to engage the second contact portion 84 of the installation tool 80 with the bearing surface 88 of the second clamping arm 50. As can be seen in FIG. 2A, when the upper end 108 is urged in the direction indicated by arrow "G", the second clamping arm 50 is urged by the installation tool 80 in the direction indicated by arrow "B".

At the same time as the second contact portion 84 urges the second clamping arm 50 in the direction indicated by arrow "B", the first contact portion 82 pulls the bracing element 58 generally in the direction indicated by arrow "F". Because the connector portion 34 is connected with the bracing element 58 via the curved wall 46, the connector portion 34 is pulled as a result in the direction indicated by arrow "C" in FIG. 2A. (As can be seen in FIG. 2A, the first direction "A" preferably is substantially parallel with the direction indicated by arrow "C".) In turn, the tension to which the connector portion 34 is subjected also urges the first clamping arm 42 in the direction indicated by arrow "A" in FIG. 2A. From the foregoing, it can be seen that applying the installation tool 80 as described above results in both of the first and second clamping arms 42, 50 being urged in opposite directions, i.e., toward the first and second sides 26, 28 of the rail 30 respectively. The result is that, simultaneously, the first engagement portion 64 is urged against the lower surface 68 of the first tuned mass damper 22, and the second engagement portion 70 is urged against the lower surface 74 of the second tuned mass damper 24.

It will also be understood that, when the first contact portion 82 urges the bracing element 58 in the direction indicated by arrow "F", the lower edge element 98 may be moved outwardly, i.e., in the direction indicated by arrow "C". In this way, when the installation tool 80 is applied to urge the first and second clamping arms 42, 50 generally toward each other as described above, the lower edge element 98 simultaneously is positioned in a selected notch 106 which can hold the first and second clamping arms 42, 50 in position, i.e., held then urged against the first and second tuned mass dampers 22, 24 respectively. Because of the positioning of the lower edge element 98 in the selected notch 106 when the installation tool 80 is applied, the bar element 32 and the second clamping arm 50 are held locked together thereby, when the installation tool 80 is removed.

Those skilled in the art would appreciate that the bar element and the second clamping arm may be made of any suitable material, or materials. For example, in one embodiment, the bar element 32 preferably is made of spring steel. This enables the connector portion 34 to deform upwardly toward the foot 40 of the rail 30, when the first and second engagement portions 64, 70 are urged against the first and second tuned mass dampers 22, 24 respectively. The upward deformation of the connector portion 34 is in the direction indicated by arrow "H" in FIG. 2A.

Also, those skilled in the art would appreciate that the second clamping arm 50 may be made of mild steel, or spring steel.

In one embodiment, the invention preferably includes a system 110 that includes the clip assembly 20 and the installation tool 80. In use, as outlined above, the linkage section 44 of the bar element 32 is inserted underneath the left (or first) side 76 of the foot 40 and pushed through the ballast 75 underneath the foot 40 until the connector portion 34 of the bar element 32 is in the predetermined location thereof, relative to the first and second tuned mass dampers 22, 24. At this point, the linkage section 44 preferably is generally proximal to the side 78 of the foot 40 that is below the second tuned mass damper 24, i.e., the linkage section is also in its predetermined location. When the connector portion 34 is in its predetermined location, the first clamping arm 42 is engaged with the first tuned mass damper 22.

Once the connector portion 34 and the linkage section 44 are in their predetermined locations, the locking portion body 90 of the locking portion 56 of the second clamping arm 50 is inserted into the opening 48 of the curved wall 46 of the linkage section 44, so that a selected one of a number of locking elements 102 on a lower surface of the locking portion body 90 is engageable with a lower edge element 98 of the curved wall 46 that partially defines the opening 48. The installation tool 80 is used to secure the second clamping arm 50 to the linkage section 44, as described above. Once the second clamping arm 50 is secured to the linkage section 44, the locking portion 56 of the second clamping arm 50 is held in the linkage section 44 by the lower edge element 98 engaging the selected one of the locking elements 102.

The installation tool 80 is positioned to engage the first contact portion 82 of the installation tool 80 with the bracing element 58 of the curved wall 46, and also to engage the second contact portion 84 thereof with the bearing surface 88 of the second clamping arm 50. With the first contact portion 82 of the installation tool 80, the bracing element 58 is pulled at least partially in the first direction, to urge the first clamping arm 42 against the first tuned mass damper 22. With the second contact portion 84 of the installation tool 80, pressure is exerted on the bearing surface 88 in the second direction, to urge the second clamping arm in the second direction against the second tuned mass damper 24.

As noted above, the tuned mass dampers 22, 24 preferably include a suitable elastomeric material. Due to the resilience of the spring steel of the bar element 32 and the resilience of the elastomeric material in the tuned mass dampers, the bar element 32 preferably is subjected to tension as the installation of the clip assembly 20 is completed, so that once the locking elements 102 are engaged with the lower edge element 98 of the curved wall 46, they tend to stay so engaged.

Alternative embodiments of the invention are illustrated in FIGS. 5B-8. In one embodiment, the invention includes a tuned mass damper 222 (FIG. 6A) for damping airborne vibrations at one or more rail frequencies from the rail 30 that are generated by movement of wheels (not shown) over the rail 30 (FIG. 5A). As previously described, the rail 30 includes the web portion "W" thereof, supported by the foot 40 thereof. The web portion "W" and the foot 40 define first and second pockets 212, 214 on opposite first and second sides 26, 28 of the rail 30 (FIG. 5A). It is preferred that the tuned mass damper 222 includes one or more damper elements 216 made of a damper element material, and a body element 218 made of a body material (FIGS. 7A, 7B), as will be described. Preferably, the damper element 216 is at least partially embedded in the body element 218 (FIG. 7A). As can be seen in FIGS. 5B, 6A, 6B, and 7B, the body element 218 preferably includes inner and lower exterior surfaces 223, 225 that are formed to fit within the first and second pockets 212, 214.

As will also be described, it is also preferred that the damper element material and the body material are selected and formed so that the tuned mass damper 222 vibrates in response to movement of the wheels over the rail 30 at one or more damper frequencies that at least partially interfere with the rail frequency, or frequencies.

Those skilled in the art would appreciate that vibrations of the rail that are generated when the train wheels move over the rail typically are at, or have, one or more natural frequencies, referred to hereinafter as "rail frequencies". In theory, at a certain target rail frequency, in the absence of the tuned mass damper, the traffic-related vibrations of the rail reach a peak amplitude. However, in practice, an installed rail is a complex system that may have more than one natural frequency. Accordingly, the target rail frequencies herein are approximately the one or more natural frequencies of the rail, as installed.

Those skilled in the art would appreciate that the mass and the stiffness characteristics of the tuned mass damper are determined so that the amplitude of the traffic-related vibrations of the rail at the one or more target rail frequencies are lowered, or decreased. In order to achieve this, when wheels move over the rail, the tuned mass damper preferably vibrates at one or more damper frequencies that interfere with, or at least partially interfere with, the one or more target rail frequencies. The amplitude of the vibrations of the rail is then less than the peak amplitude. The one or more damper frequencies are approximately the same as the natural frequencies of the tuned mass damper. Those skilled in the art would appreciate that, in theory, the damper frequency preferably is the same or substantially the same as the rail frequency, but the damper frequency is out of phase with the rail frequency, in order to interfere with the rail frequency.

Those skilled in the art would be aware of suitable methods of determining the rail frequencies.

Figure 5A:
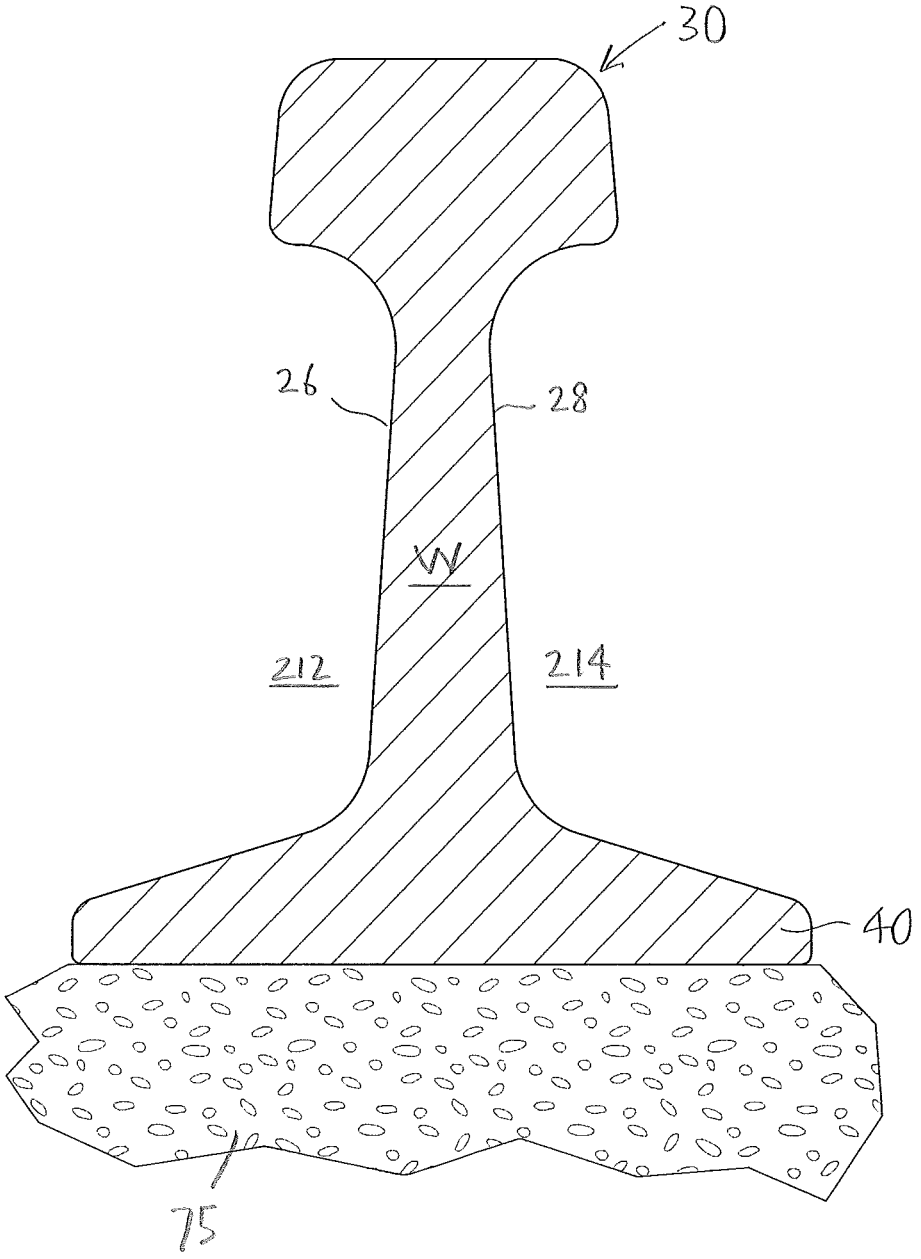
FIG. 5A (PRIOR ART)
FIG. 5A is a cross-section of a typical rail of the prior art.

As can be seen in FIG. 5A, the foot 40 is engaged with and partially supported by ballast 75. It will be understood that, as noted above, the tuned mass dampers preferably are installed on the rail in the portions thereof between railway ties.

Figure 5B:
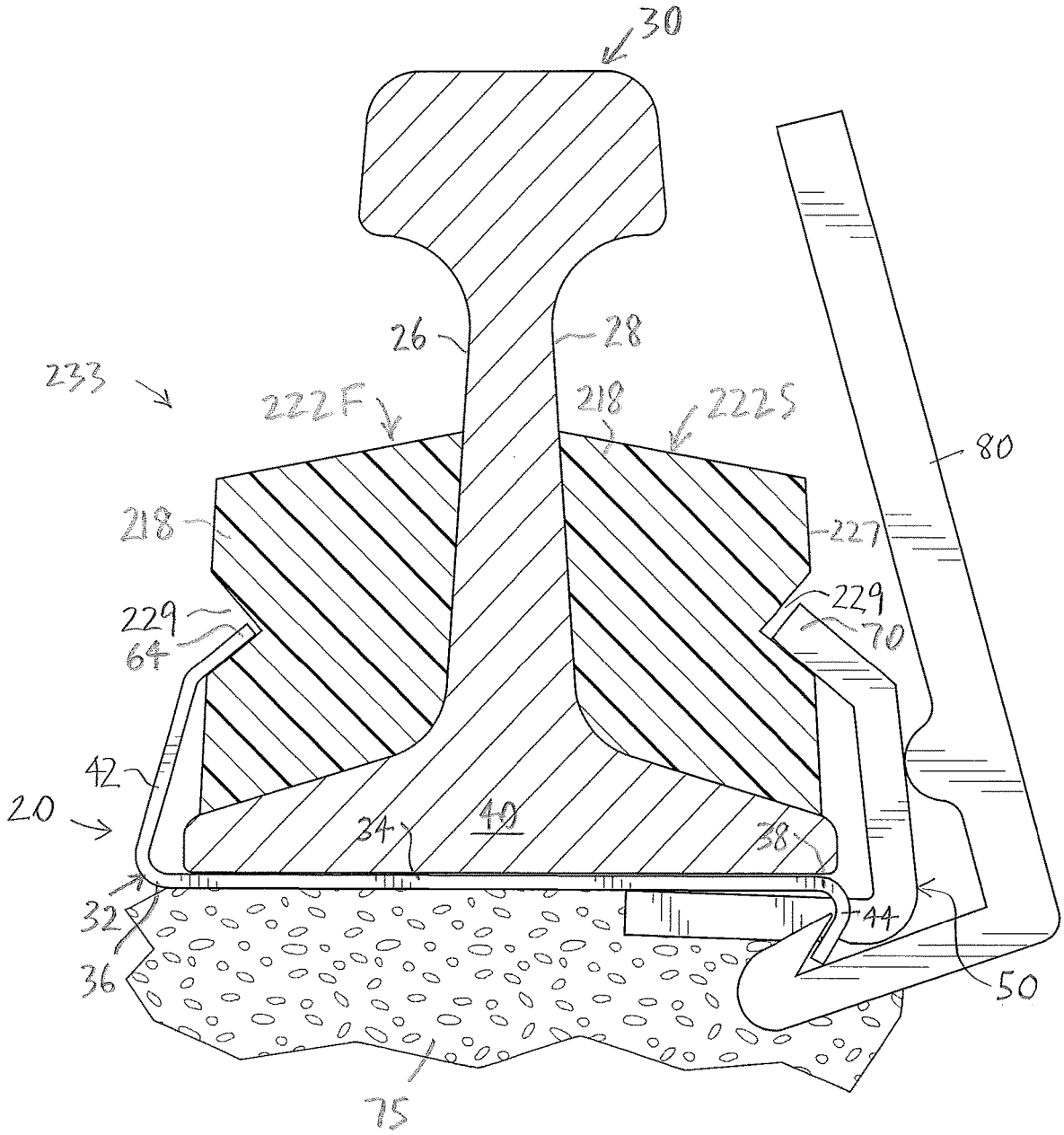
FIG. 5B is a cross-section of the rail with embodiments of the first and second tuned mass dampers of the invention held against the rail by an embodiment of the clip assembly of the invention.
Figure 6A:
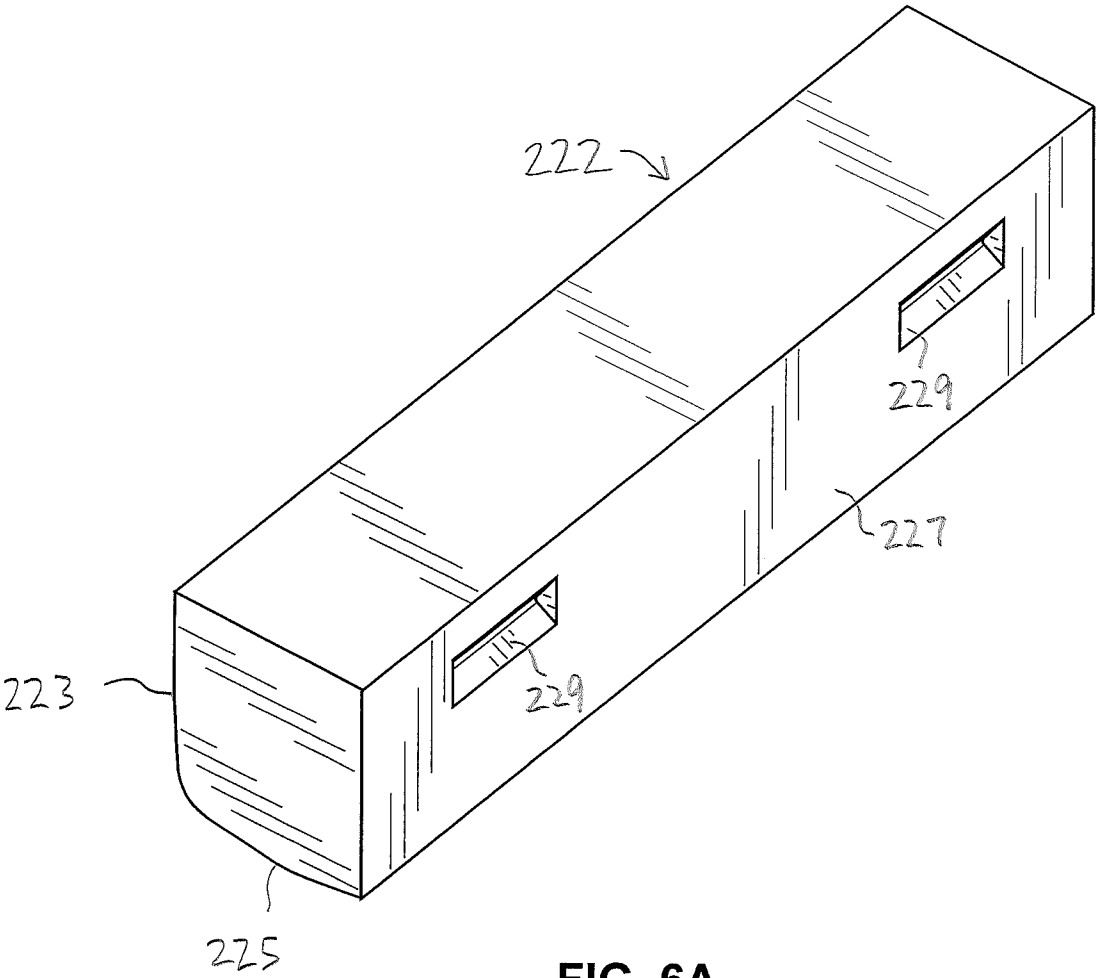
FIG. 6A is an isometric view of an alternate embodiment of the tuned mass damper of the invention.
Figure 6B:
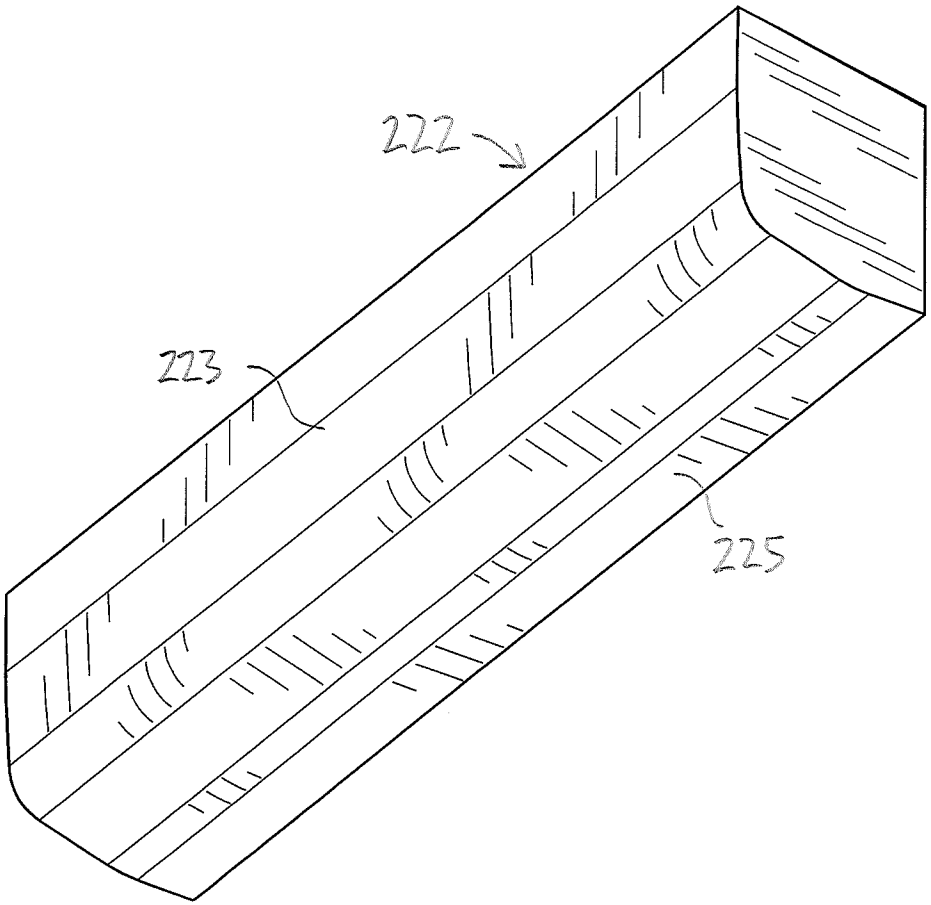
FIG. 6B is another isometric view of the tuned mass damper of FIG. 5A.
Figure 6C:
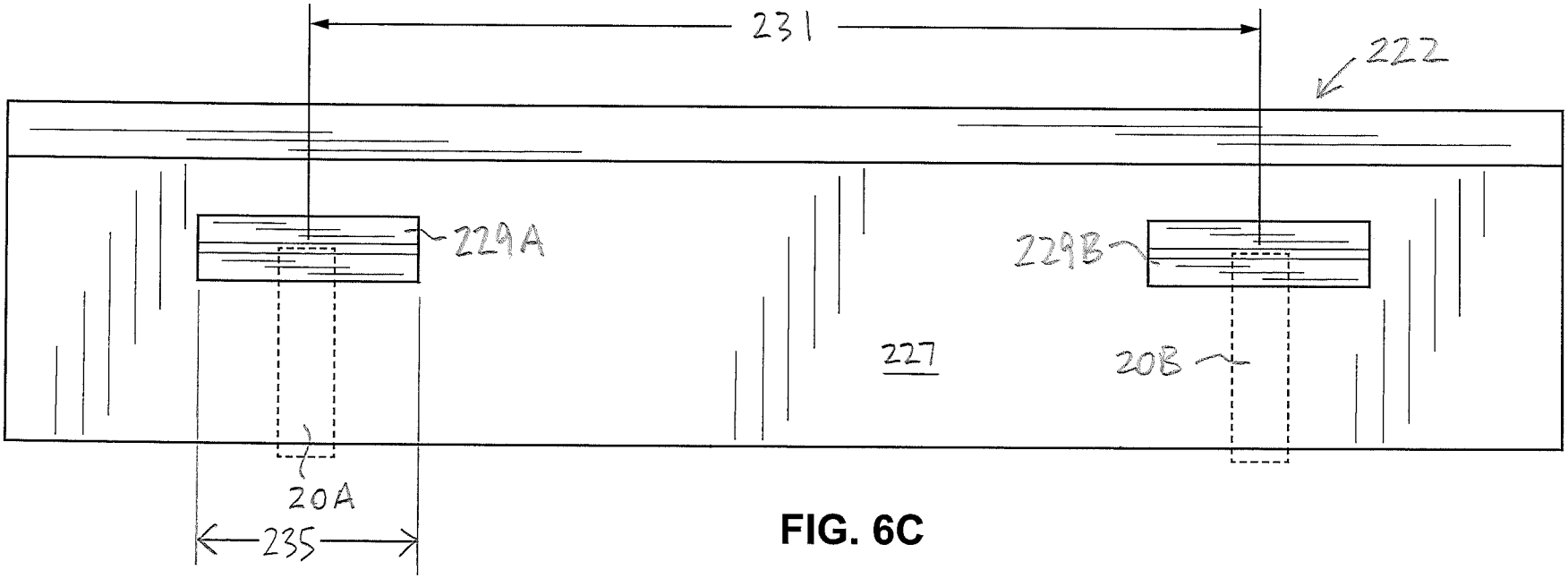
FIG. 6C is a side view of the tuned mass damper of FIGS. 5A and 5B.

As can be seen in FIGS. 5B, 6A, 7B, and 7C, it is also preferred that the body element 218 includes an outer exterior surface 227 that is located opposite to the inner exterior surface 223 thereof. The outer exterior surface 227 preferably includes two or more slots 229 (FIG. 6A) spaced apart from each other by a predetermined distance 231 (FIG. 6C). For clarity of illustration, the two slots illustrated in FIG. 6C are identified by reference characters 229A, 229B.

In use, the tuned mass damper 222 preferably is formed to be provided in pairs thereof. For example, as illustrated in FIG. 5B, a first and a second tuned mass damper 222F, 222S preferably are formed to be located in the first and second pockets 212, 214. It will be understood that the two slots 229A, 229B are formed to receive the engagement portions (i.e., first or second engagement portions, as the case may be) of two clip assemblies 20A, 20B (FIG. 6C) that are to be located spaced apart by the predetermined distance 231 by the slots 229A, 229B respectively in relation to the tuned mass dampers and the rail.

It will be understood that the first and second tuned mass dampers are identified by reference characters 222F, 222S respectively in FIG. 5B for clarity of illustration. The slots as illustrated in the first and second tuned mass dampers respectively are identified in FIG. 5B with reference character 229F.

It will also be understood that the tuned mass damper 222 illustrated in FIG. 6C may be the first or the second tuned mass damper. For clarity of illustration, the slots are identified in FIG. 6C by reference characters 229A, 229B.

The body material may be any suitable material. It is preferred that the body material is any suitable elastic material. In one embodiment, the body material preferably is an elastomer. In one embodiment, the elastomer preferably is urethane.

Also, the damper element material may be any suitable material. Preferably, the damper element material is an inelastic material. In one embodiment, the damper element preferably is steel.

As noted above, in practice, the installed rail may have a number of natural (rail) frequencies. For example, the rail frequencies may include respective first and second rail frequencies. In these circumstances, it is preferred that the damper element includes a first damper element 216U formed and located in the body element 218 to vibrate at a first damper frequency that at least partially interferes with the first rail frequency, and a second damper element 216L formed and located in the body element 218 to vibrate at a second damper frequency that at least partially interferes with the second rail frequency. For clarity of illustration, the first and second damper elements are identified by reference characters 216U, 216L in FIGS. 7B, 7C, and 8.

It will be understood that the tuned mass damper 222 may include any suitable number of damper elements 216, for example, one, two (as described above), or more than two.

Those skilled in the art would appreciate that the rail frequencies may, alternatively, include more than two rail frequencies. In these circumstances, the damper elements 216 preferably include a corresponding number of multiple damper elements. The damper frequencies preferably include a corresponding number of multiple damper frequencies. Each of the multiple damper elements 216 preferably is formed and located in the body element to vibrate at a selected one of the multiple damper frequencies for at least partially interfering with a selected one of the number of rail frequencies.

Figure 7A:
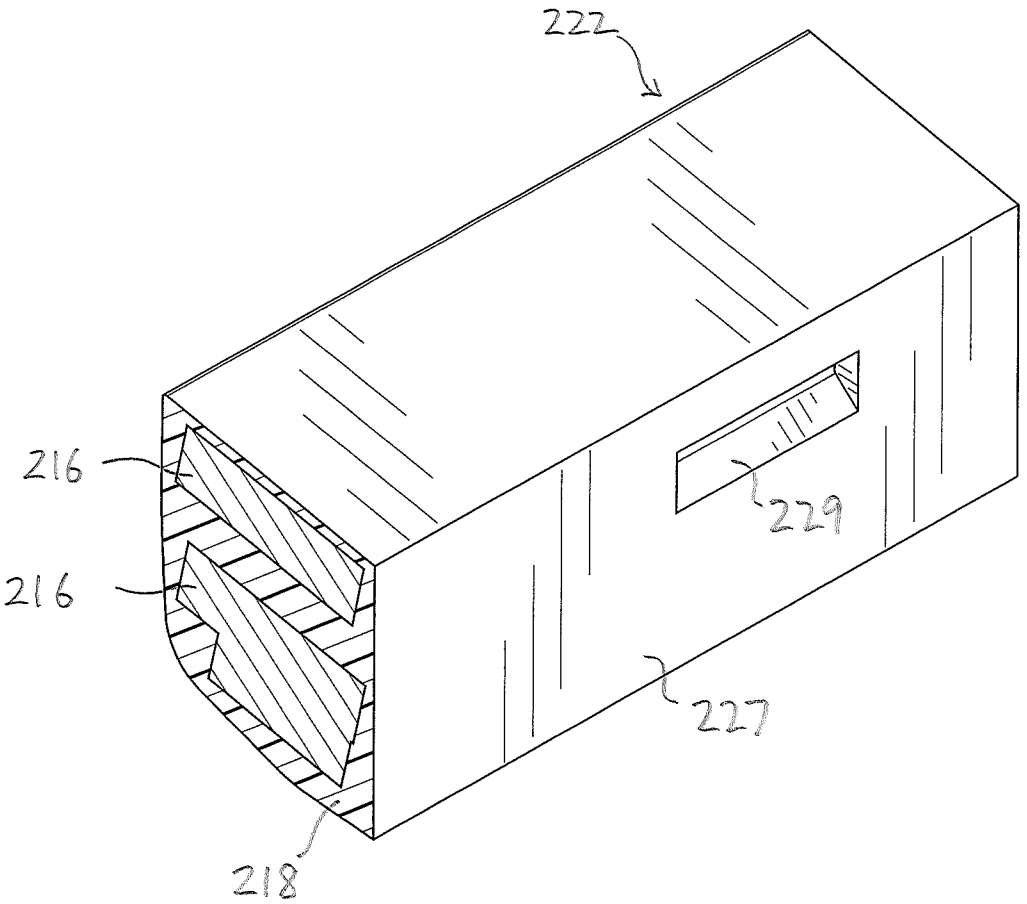
FIG. 7A is an isometric view of a cross-section of the tuned mass damper of FIG. 5A.
Figure 7C:
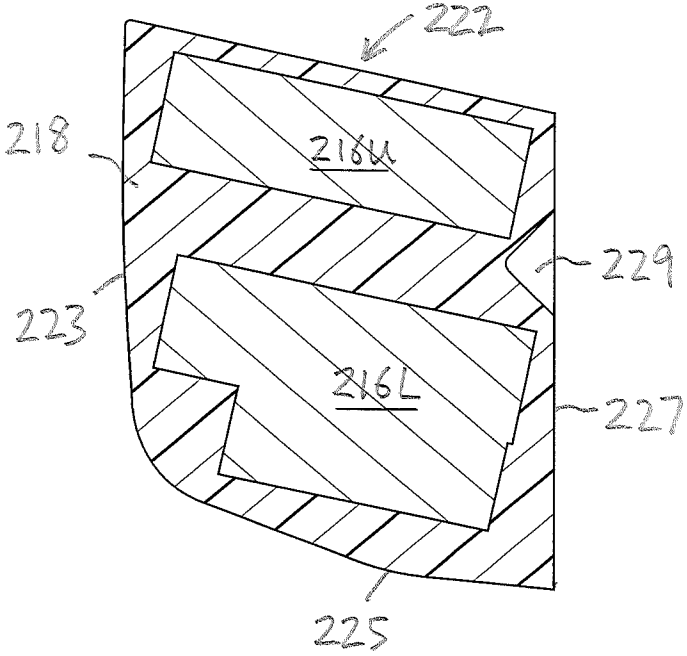
FIG. 7C is another cross-section of the tuned mass damper of FIG. 5A.
Figure 7B:
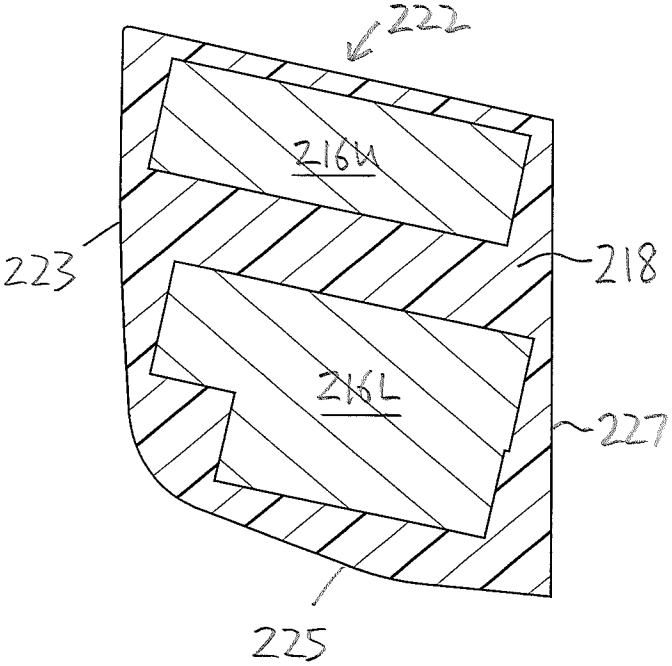
FIG. 7B is a cross-section of the tuned mass damper of FIG. 5A in which damper elements are shown.
Figure 8:
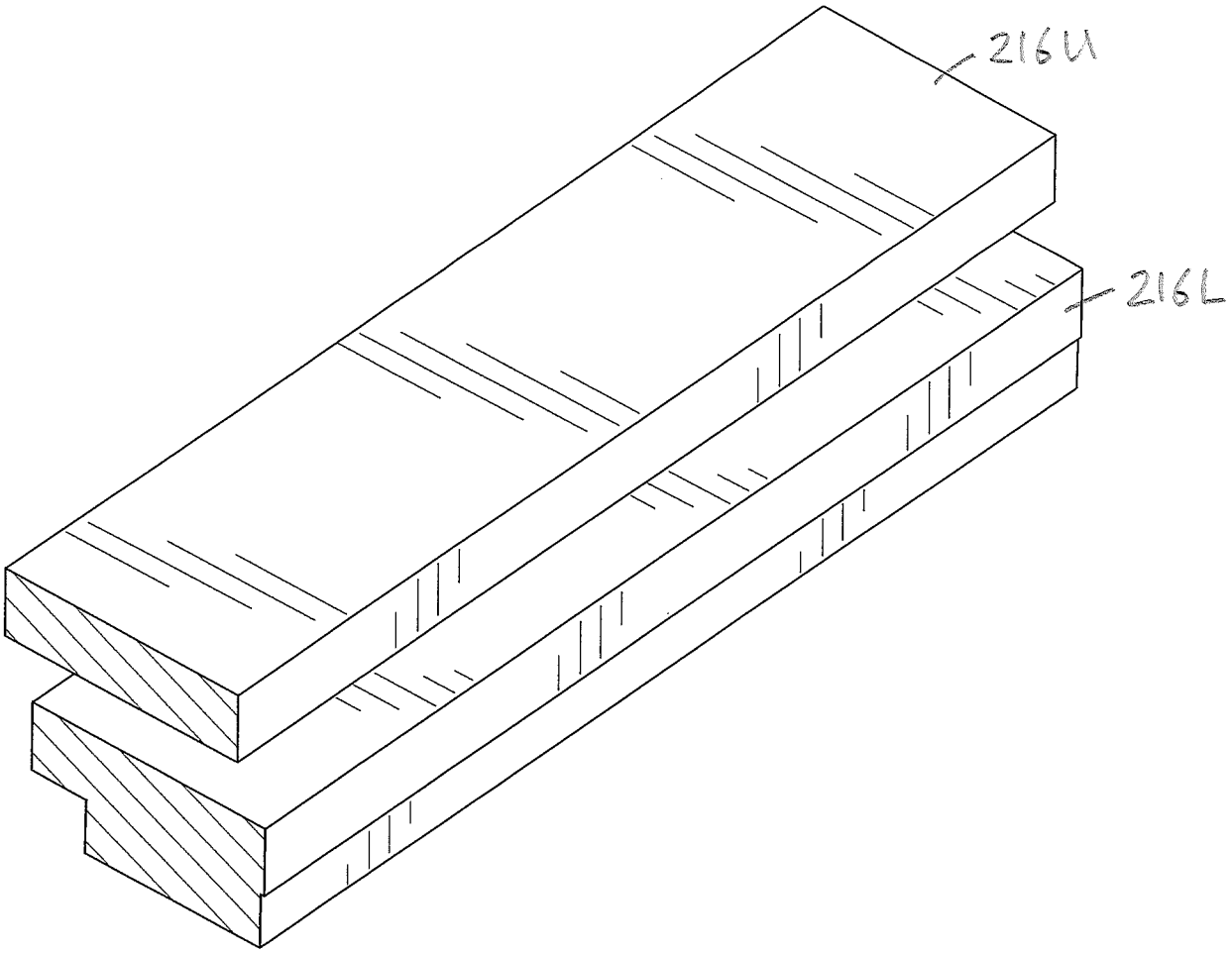
FIG. 8 is an isometric view of damper elements in the tuned mass damper of FIGS. 5A-6C.

The invention preferably also includes a system 233 for damping airborne vibrations at the one or more rail frequencies from the rail 30 generated by movement of wheels over the rail. As can be seen in FIG. 5B, in one embodiment, the system 233 preferably includes first and second tuned mass dampers 222F, 222S formed to be positioned in the first and second pockets 212, 214 respectively. As described above, each tuned mass damper 222F, 222S preferably includes one or more damper elements 216 including a damper element material (not shown in FIG. 5B), and a body element 218 including a body material. As illustrated in FIG. 7A, the damper element 216 preferably is at least partially embedded in the body element 218. Preferably, the body element 218 has inner and lower exterior surfaces 223, 225 (FIG. 6B) formed to fit within the first and second pockets 212, 214 (FIGS. 5A, 5B). As described above, the damper element material and the body material are selected and formed so that each of the tuned mass dampers 222 vibrates in response to movement of the wheels over the rail 30 at one or more damper frequencies that at least partially interfere with the rail frequency (or frequencies, as the case may be).

In one embodiment, the system 233 preferably also includes one or more clip assemblies 20 for securing the first and second tuned mass dampers 222F, 222S in the first and second pockets 212, 214 respectively. As described above, the clip assembly 20 preferably includes the bar element 34 and the second clamping arm 50. In one embodiment, the bar element 32 preferably includes the connector portion 34 extending between first and second ends 36, 38 thereof and formed to be positioned in a predetermined location relative to the rail 30 at least partially under the foot 40 of the rail 30, and the first clamping arm 42 connected with the connector portion 34 at the first end 36 of the connector portion 34. As can be seen in FIG. 5B, the first clamping arm 42 is formed to engage the first tuned mass damper 222F with the first engagement portion 64 thereof to urge the first tuned mass damper 222F against the first side 26 of the rail 30 and at least partially downwardly toward the foot 40, when the connector portion 34 is in the predetermined location. Preferably, the bar element 32 also includes the linkage section 44 connected with the connector portion 34 at the second end 38 of the connector portion 34.

The clip assembly 20 is also illustrated in FIGS. 1A-2C. As described above, the linkage section 44 preferably includes the curved wall 46 with the opening 48 therein. The second clamping arm 50 extends between upper and lower ends 52, 54 thereof. The lower end 54 includes a locking portion 56 at least partially receivable in the opening 48 in the curved wall 46. The locking portion 56 preferably is securable to the linkage section 44. The upper end 52 preferably is formed for engagement with the second tuned mass damper 222S with the second engagement portion 70 thereof, to urge the second tuned mass damper 222S against the second side 28 of the rail 30 and at least partially downwardly toward the foot 40.

In one embodiment of the system 233, the system 233 preferably includes a first clip assembly and a second clip assembly. For clarity of illustration, the two clip assemblies are identified by reference characters 20A and 20B in FIG. 6C. As can be seen in FIG. 6C, the slots 229A, 229B on the first tuned mass damper 222F are each formed to at least partially receive the first engagement portions 64 of the first clamping arm of each of the first and second clip assemblies 20A, 20B. Preferably, the two slots 229A, 229B are spaced apart by a predetermined distance.

It can be seen in FIG. 6C that, because the slots 229A, 229B are separated by the predetermined distance 231, the clip assemblies 220A, 220B are required to be spaced apart by approximately the predetermined distance 235, upon installation of the tuned mass dampers 222F, 222S. Those skilled in the art would appreciate that each of the slots 229A, 229B has a width 235 (FIG. 6C) that is larger than the widths of either of the engagement portions 64, 70, to facilitate installation of the clip assemblies.

Those skilled in the art would also appreciate that the first and second tuned mass dampers at a particular installation preferably each have approximately the same length, and the slots 229A, 229B on each of the tuned mass dampers are spaced apart by the predetermined distance 231.

It will be understood that the two slots 229A, 229B on the second tuned mass damper 222S are each formed to at least partially receive the second engagement portion 70 of the second clamping arm 50 of each of the first and second clip assemblies 20A, 20B. The slots 229A, 229B are spaced apart by the predetermined distance 231, to locate the first and second clip assemblies 20A, 20B in preselected respective locations relating to the rail 30, spaced apart from each other by the predetermined distance 231.

It will be understood that the clip assembly 20 may be installed to hold the first and second tuned mass dampers 222F, 222S in the first and second pockets 212, 214 respectively by using the installation tool 80, as described above (FIGS. 3 and 5B). Preferably, and as described above, the installation tool 80 is configured for engagement with the curved wall 46 and the second clamping arm 50, for urging the first and second clamping arms 42, 50 against the first and second tuned mass dampers 222F, 222S respectively, and to secure the locking portion to the linkage section.

Those skilled in the art would appreciate that the rail frequencies generated at the first and second sides 26, 28 of the rail 30 by traffic over the rail may differ from each other. That is, the one or more rail frequencies may include one or more first rail frequencies associated with the first side 26 of the rail, and one or more second rail frequencies associated with the second side 28 of the rail. In these circumstances, the one or more damper elements 216 located in the first tuned mass damper 222F are formed to vibrate at a first damper frequency (or frequencies) that at least partially interferes with the first rail frequency (or frequencies, as the case may be). The one or more damper elements 216 located in the second tuned mass damper 222S are formed to vibrate at a second damper frequency (or frequencies) that at least partially interferes with the one or more second rail frequency (or frequencies, as the case may be).

The invention preferably also includes a method of reducing airborne vibrations generated upon movement of wheels over a rail. The first and second tuned mass dampers are formed to dampen airborne vibrations at the one or more rail frequencies. The first and second tuned mass dampers are positioned in the first and second pockets, and one or more clip assemblies are provided, to secure the first and second tuned mass dampers therein. The one or more clip assemblies are installed to engage the first and second tuned mass dampers, to secure the first and second tuned mass dampers in the first and second pockets respectively.

It will be appreciated by those skilled in the art that the invention can take many forms, and that such forms are within the scope of the invention as claimed. The scope of the claims should not be limited by the preferred embodiments set forth in the examples, but should be given the broadest interpretation consistent with the description as a whole.

We claim:

1. A system for damping airborne vibrations at at least one rail frequency from a rail generated by movement of wheels over the rail, the rail having a web portion supported by a foot thereof, the web portion and the foot defining first and second pockets on opposite first and second sides of the rail respectively, the system comprising:

first and second tuned mass dampers formed to be positioned in the first and second pockets respectively, each said tuned mass damper comprising:

at least one damper element comprising a damper element material;

a body element comprising a body material, said at least one damper element being at least partially embedded in the body element, the body element having inner and lower exterior surfaces formed to fit within the first and second pockets;

the damper element material and the body material being selected and formed such that the tuned mass damper vibrates in response to movement of the wheels over the rail at at least one damper frequency that at least partially interferes with said at least one rail frequency;

at least one clip assembly for securing the first and second tuned mass dampers in the first and second pockets respectively, said at least one clip assembly comprising:

a bar element comprising:

a connector portion extending between first and second ends thereof and formed to be positioned in a predetermined location relative to the rail at least partially under the foot of the rail;

a first clamping arm connected with the connector portion at the first end of the connector portion, the first clamping arm being formed to engage the first tuned mass damper with a first engagement portion thereof to urge the first tuned mass damper against the first side of the rail and at least partially downwardly toward the foot, when the connector portion is in the predetermined location;

a linkage section connected with the connector portion at the second end of the connector portion, the linkage section comprising a curved wall with an opening therein; and a second clamping arm extending between upper and lower ends thereof, the lower end comprising a locking portion at least partially receivable in the opening in the curved wall, the locking portion being securable to the linkage section, and the upper end being formed for engagement with the second tuned mass damper with a second engagement portion thereof, to urge the second tuned mass damper against the second side of the rail and at least partially downwardly toward the foot.

2. The system according to claim 1 in which, in each said tuned mass damper:

the body element includes an outer exterior surface located opposite to the inner surface thereof; and the outer exterior surface comprises at least two slots spaced apart from each other by a predetermined distance.

3. The system according to claim 2 in which;

said at least one clip assembly comprises a first clip assembly and a second clip assembly;

said at least two slots on the first tuned mass damper are each formed to at least partially receive the first engagement portion of the first clamping arm of each of the first and second clip assemblies, and said at least two slots are spaced apart by a predetermined distance; and said at least two slots on the second tuned mass damper are each formed to at least partially receive the second engagement portion of the second clamping arm of each of the first and second clip assemblies, and said at least two slots are spaced apart by the predetermined distance, to locate the first and second clip assemblies in preselected respective locations relating to the rail, spaced apart from each other by the predetermined distance.

4. The system according to claim 1 additionally comprising:

an installation tool configured for engagement with the curved wall and the second clamping arm, for urging the first and second clamping arms against the first and second tuned mass dampers respectively, and to secure the locking portion to the linkage section.

5. The system according to claim 1 in which the body element comprises an elastic material.

6. The system according to claim 5 in which the elastic material comprises an elastomer.

7. The system according to claim 1 in which said at least one damper element comprises an inelastic material.

8. The system according to claim 7 in which the inelastic material comprises steel.

9. The system according to claim 1 in which said at least one rail frequency includes respective first and second rail frequencies and said at least one damper element comprises:

a first damper element formed and located in the body element to vibrate at a first damper frequency that at least partially interferes with the first rail frequency; and a second damper element formed and located in the body element to vibrate at a second selected natural frequency that at least partially interferes with the second rail frequency.

10. The system according to claim 1 in which said at least one rail frequency includes a plurality of rail frequencies, said at least one damper element comprises a corresponding number of multiple damper elements, and said at least one damper frequency comprises a corresponding number of multiple damper frequencies, each of said multiple damper elements being formed and located in the body element to vibrate at a selected one of the multiple damper frequencies for at least partially interfering with a selected one of the plurality of rail frequencies.

11. The system according to claim 1 in which said at least one rail frequency includes at least one first rail frequency associated with the first side of the rail and at least one second rail frequency associated with the second side of the rail, and in which:

said at least one damper element located in the first tuned mass damper is formed to vibrate at a first damper frequency that at least partially interferes with said at least one first rail frequency; and said at least one damper element located in the second tuned mass damper is formed to vibrate at a second damper frequency that at least partially interferes with said at least one second rail frequency.

* * * * *